US011244661B2

(12) United States Patent
Tanabe

(10) Patent No.: US 11,244,661 B2
(45) Date of Patent: Feb. 8, 2022

(54) SOUND DAMPING DEVICE AND VIBRATION DETECTION DEVICE

(71) Applicant: Yamaha Corporation, Shizuoka (JP)

(72) Inventor: Emi Tanabe, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 17/013,489

(22) Filed: Sep. 4, 2020

(65) Prior Publication Data

US 2020/0402484 A1 Dec. 24, 2020

Related U.S. Application Data

(63) Continuation of application No. PCT/JP2018/011000, filed on Mar. 20, 2018.

(51) Int. Cl.

| | |
|---|---|
| ***G10D 13/02*** | (2020.01) |
| ***G10D 13/14*** | (2020.01) |
| ***G10D 13/10*** | (2020.01) |

(52) U.S. Cl.

CPC ..... *G10D 13/02* (2013.01); *G10D 13/14* (2020.02); *G10D 13/25* (2020.02)

(58) Field of Classification Search

CPC ..... G10D 13/02; G10D 13/14; G10D 13/25; G10D 13/00; G10D 13/10

See application file for complete search history.

(56) References Cited

U.S. PATENT DOCUMENTS

| | | | | |
|---|---|---|---|---|
| 6,031,176 A * | 2/2000 | Tanaka | ..... | G10H 3/146 84/730 |
| 2003/0037660 A1 | 2/2003 | Suenaga | | |
| 2004/0118269 A1 | 6/2004 | Yoshino | | |

FOREIGN PATENT DOCUMENTS

| | | | | |
|---|---|---|---|---|
| JP | S54-133827 U | | 9/1979 | |
| JP | S54-133829 U | | 9/1979 | |
| JP | 3004768 U | | 9/1994 | |
| JP | 2001142459 A | | 5/2001 | |
| JP | 2004198657 A | | 7/2004 | |
| JP | 2016021026 A | | 2/2016 | |
| KR | 20120063201 A | * | 6/2012 | ..... G10D 13/02 |
| KR | 20120063201 A | | 6/2012 | |

OTHER PUBLICATIONS

International Search Report in PCT/JP2018/011000, dated Jun. 12, 2018.

Translation of Office Action in the corresponding Japanese Patent Application No. 2020-507158, dated Mar. 17, 2021.

* cited by examiner

*Primary Examiner* — Kimberly R Lockett

(74) *Attorney, Agent, or Firm* — Global IP Counselors, LLP

(57) ABSTRACT

A sound damping device includes a sound damper and a support member. The sound damper includes a contact surface configured to contact a vibration member and includes a through-hole having a first opening formed on the contact surface. The support member is coupled to the sound damper to support the sound damper and cause the vibration member and the contact surface to come into contact with each other. The support member includes an air hole that is connected to the through-hole of the sound damper and that penetrates through the support member.

11 Claims, 7 Drawing Sheets

SOUND DAMPING DEVICE AND VIBRATION DETECTION DEVICE

CROSS-REFERENCE TO RELATED APPLICATIONS

This application is a continuation application of International Application No. PCT/JP2018/011000, filed on Mar. 20, 2018. The entire disclosures of International Application No. PCT/JP2018/011000 are hereby incorporated herein by reference.

BACKGROUND

Technological Field

The present invention relates to a sound damping device, a sound damping method, and a vibration detection device for a percussion instrument such as an acoustic drum.

Background Information

A muting member is used for muting the sound of a percussion instrument such as an acoustic drum. The muting member is attached to a vibration member of the percussion instrument and suppresses the vibrations of the vibration member to thereby reduce the sound volume of the percussion instrument.

In the muted drum head disclosed in Utility Model Registration No. 3004768, a vibration absorber is attached to the rear surface of the drum head, so that the vibrations of the drum head are suppressed to reduce the sound volume of the drum.

A muting member is also used in an electronic drum in a drum head (drum pad) in order to mute the sound generated by impact. The electronic percussion instrument disclosed in Japanese Laid-Open Patent Publication No. 2004-198657 comprises a cushion member that is supported by a support member on the rear surface of the drum head.

SUMMARY

However, in recent years there has been demand for a sound damper that can appropriately reduce the sound volume of, specifically, a percussion instrument that emits a high volume of sound, such as a bass drum of an acoustic drum.

The vibration absorber disclosed in Utility Model Registration No. 3004768 is attached merely to the drum head and is unsupported. Therefore, the vibration absorber disclosed in Utility Model Registration No. 3004768 has little effect on reducing the sound volume of, for example, a percussion instrument that emits a high volume of sound, such as a bass drum of an acoustic drum.

On the other hand, the cushion member disclosed in Japanese Laid-Open Patent Publication No. 2004-198657 is supported by a support member. The cushion member supported by the support member is very effective in reducing the sound volume of, for example, a percussion instrument that emits a high volume of sound, such as a bass drum of an acoustic drum. However, a sound damper supported by a support member reduces most of the sound volume of the percussion instrument.

In view of the circumstances described above, an object of this disclosure is to provide a sound damper and a sound damping method that can appropriately reduce the sound volume of a percussion instrument. Furthermore, another object of this disclosure is to provide a vibration detection device provided with a vibration detection unit in a sound damper that can appropriately reduce the sound volume.

In order to solve the problem described above, this disclosure proposes the following means. The sound damping device of this disclosure comprises a sound damper and a support member. The sound damper includes a contact surface configured to contact a vibration member and includes a through-hole having a first opening formed on the contact surface. The support member is coupled to the sound damper to support the sound damper and cause the vibration member and the contact surface to come into contact with each other. The support member has an air hole that is connected to the through-hole of the sound damper and that penetrates through the support member.

A sound damping method of this disclosure comprises causing a vibration member and a sound damper to come into contact with each other, transmitting air vibrations generated by vibrations of the vibration member via a through-hole formed in the sound damper, and transmitting the air vibrations via an air hole that is formed in a support member coupled to the sound damper to support the sound damper and that penetrates through the support member.

A vibration detection device of this disclosure comprises a sound damper and a support member. The sound damper includes a contact surface configured to contact a vibration member and includes a through-hole having a first opening formed on the contact surface. The support member is coupled to the sound damper to support the sound damper and cause the vibration member and the contact surface to come into contact with each other. The support member has an air hole that is connected to the through-hole of the sound damper and that penetrates through the support member. The sound damper further includes a vibration detector configured to detect vibrations.

By the sound damper and the sound damping method of this disclosure, it is possible to provide a sound damper and a sound damping method that can appropriately reduce the sound volume of a percussion instrument.

By the vibration detection device of this disclosure, it is possible to provide a device that can appropriately reduce the sound volume of a percussion instrument and that can detect vibrations.

DETAILED DESCRIPTION OF THE EMBODIMENTS

Selected embodiments of the present disclosure will now be explained below with reference to the drawings. It will be apparent to those skilled in the field from this disclosure that the following descriptions of the embodiments are provided for illustration only and not for the purpose of limiting the invention as defined by the appended claims and their equivalents.

First Embodiment

The first embodiment is described with reference to FIGS. 1 to 5.

Figure 1:
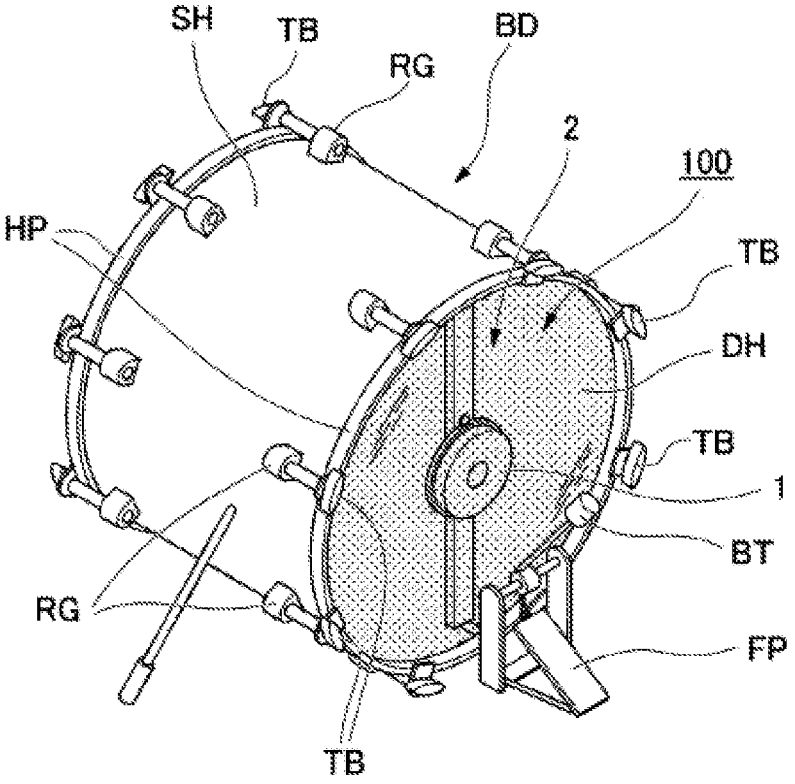
FIG. 1 is a perspective view showing an overall configuration of a sound damping device according to a first embodiment.
Figure 2:
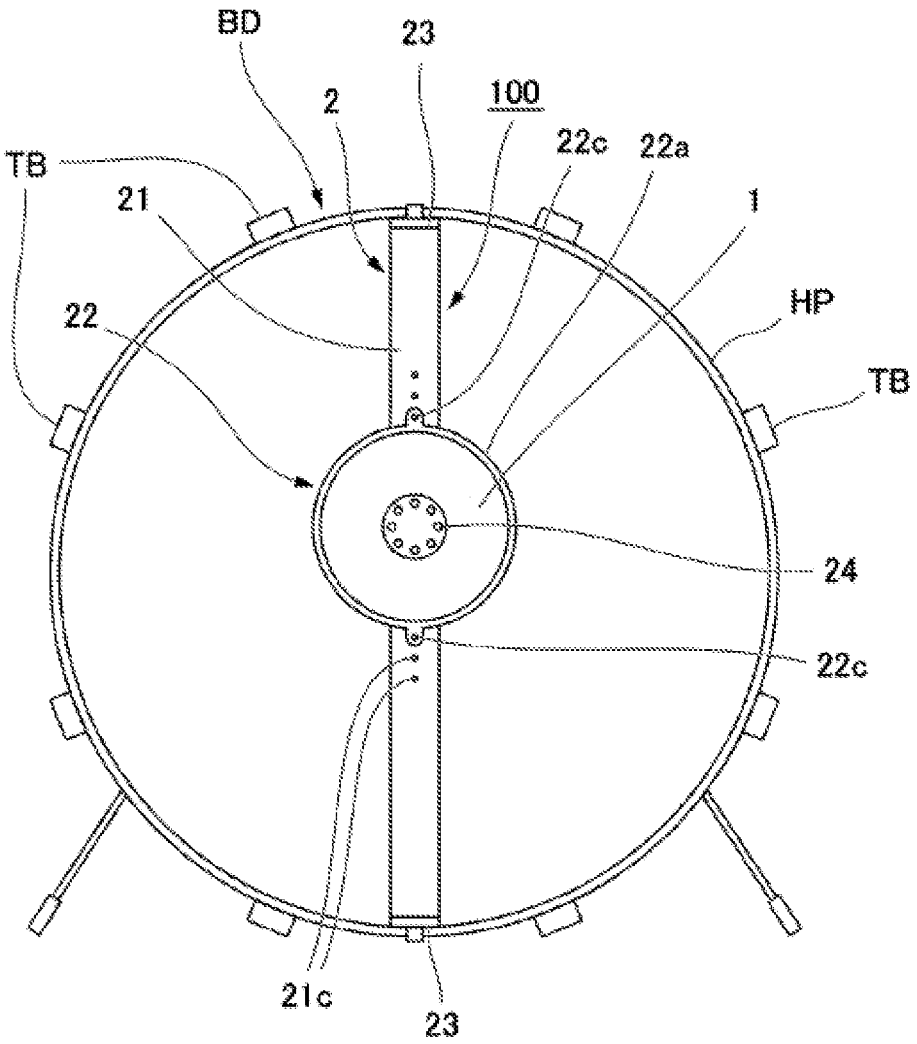
FIG. 2 is a plan view of the sound damping device.
Figure 3:
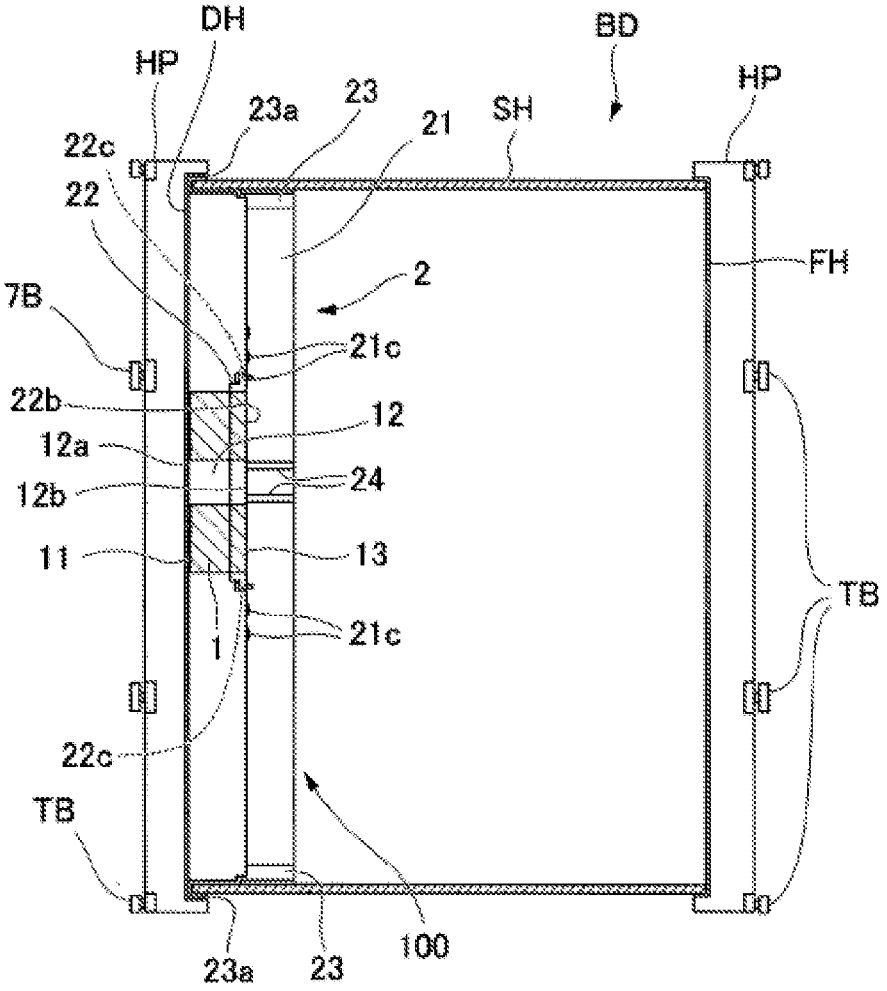
FIG. 3 is a cross-sectional view of the sound damping device.

FIG. 1 is a perspective view showing the overall configuration of a sound damping device 100 according to the present embodiment. FIG. 2 is a plan view of the sound damping device 100. FIG. 3 is a cross-sectional view of the sound damping device 100. The sound damping device 100 shown in FIGS. 1 to 3 is mounted on a bass drum BD of an acoustic drum.

As shown in FIG. 1, the sound damping device 100 has a sound damper 1 and a support member 2 coupled to the sound damper 1. The sound damping device 100 is mounted on the bass drum BD of the acoustic drum and is used for damping the bass drum BD.

In the following description, the depth direction of the bass drum BD is referred to as the "axial direction" and the direction perpendicular to the axial direction of the bass drum BD is referred to as the "radial direction."

The sound damper 1 absorbs the vibrations of a drum head (vibration member) DH and suppresses the vibrations of the drum head DH, and is formed from a material suitable for buffering vibrations, such as urethane foam or cloth. As shown in FIGS. 2 and 3, the sound damper 1 is an annular member and has a flat contact surface 11 that comes into contact with the rear surface (opposite side surface of the playing surface) of the drum head DH. As shown in FIG. 3, a supporting surface 13, which is the surface on the opposite side of the contact surface 11, is flat and supported by the support member 2.

A through-hole 12 is formed on the sound damper 1, and the through-hole 12 has a first opening 12*a* on the contact surface 11, and a second opening 12*b* on the supporting surface 13.

The support member 2 supports the sound damper 1 and causing the drum head DH and the contact surface 11 of the sound damper 1 to come into contact with each other. The support member 2 has a support member main body 21, a sound damper support portion (sound damper attachment) 22, and a mounting part 23.

The support member main body 21 is an extended member in prismatic form. As shown in FIG. 2, the longitudinal length of the support member main body 21 is slightly less than the inner diameter of the bass drum BD. Therefore, the support member main body 21 can be accommodated inside the bass drum BD with the longitudinal direction of the support member main body 21 oriented in the radial direction of the bass drum BD.

The strength of the support member main body 21 is sufficient to support the sound damper 1, which contacts the drum head DH that is vibrated by impact, to thereby maintain contact between the drum head DH and the sound damper 1. The support member main body 21 is formed from a light metal such as aluminum or from a resin such as plastic and can be a hollow member or a solid member.

The sound damper support portion 22 supports the sound damper 1 by attaching the sound damper to the support member main body 21. As shown in FIGS. 2 and 3, the sound damper support portion 22 has the form of a cylinder, with one end open and the other end closed by a bottom surface 22*b*. The sound damper support portion 22 is formed from a resin such as plastic.

A position at which the sound damper 1 is coupled to the support member 2 is adjustable. More specifically, as shown in FIGS. 2 and 3, the sound damper support portion 22 has screw holes 22*c* at positions that oppose each other in the radial direction of the outer peripheral portion of the bottom surface 22*b*. The sound damper support portion 22 is mounted on the support member main body 21 using screws by bringing the bottom surface 22*b* in contact with the support member main body 21. A plurality of screw holes 21*c* are provided on the support member main body 21, and it is possible to change the position at which the sound damper support portion 22 is mounted on the support member main body 21 by changing the screw holes 21*c* to be used for the mounting.

The supporting surface 13 of the sound damper 1 is attached to the bottom surface 22*b* of the sound damper support portion 22 using an adhesive. As shown in FIGS. 2 and 3, a side surface 22*a* of the sound damper support portion 22 surrounds the outer peripheral portion of the sound damper 1 to prevent the sound damper 1 from being displaced in the radial direction.

The support member 22 includes at least one air hole 24. In this embodiment, as shown in FIG. 3, the support member main body 21 and the sound damper support portion 22 have a plurality of air holes 24 that communicate with the through-hole 12 of the sound damper 1 and that penetrate through both the support member main body 21 and the sound damper support portion 22. As shown in FIG. 2, the plurality of air holes 24 are arranged on the same circumference as seen in the axial direction. As shown in FIG. 3, the plurality of air holes 24 communicate with the through-hole 12 via the second opening 12*b*.

As shown in FIG. 3, the mounting part 23 has a hook 23*a* at each distal end and is attached to both ends of the support member main body 21. The hooks 23*a* at the distal ends of the mounting part 23 can be hooked on the open end of a drum shell SH. As shown in FIGS. 2 and 3, the hooks of the mounting parts 23 attached to both ends of the support member main body 21 are disposed at positions that can be hooked onto the open end of the drum shell SH at the same time. As shown in FIG. 2, the mounting parts 23 that are hooked and attached to the open end of the drum shell SH are arranged at positions facing each other in the radial direction of the drum shell SH.

As shown in FIGS. 1 to 3, in the present embodiment, the sound damper 1 is mounted on the bass drum BD such that the longitudinal direction of the support member main body 21 is oriented vertically. The height position at which the sound damper 1 is mounted can be changed by changing the screw holes 21*c* that are used to mount the sound damper support portion 22.

A hoop HP attaches the drum head DH to the drum shell SH by fastening tension bolts TB and lugs RG. As shown in FIG. 3, a frame of the drum head DH is mounted on the entire circumference of the open end of the drum shell SH to which the hooks 23*a* are hooked, and the hoop HP is mounted on the outer side of the frame of the drum head DH at the open end of the drum shell SH.

As shown in FIG. 3, the drum head DH that is mounted on the drum shell SH comes into contact with the contact surface 11 of the sound damper 1.

In the support member 2, only the mounting parts 23 are in contact with the bass drum BD. The sound damping device 100 can be mounted on the bass drum BD simply by sandwiching the hooks 23*a* of the mounting parts 23 between the drum shell SH and the hoop HP, without processing the bass drum BD.

Figure 4:
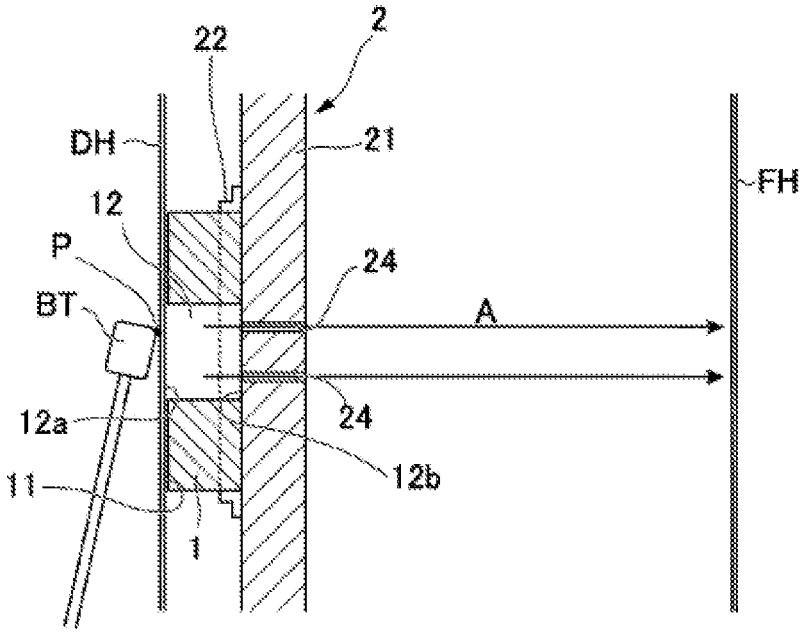
FIG. 4 is a cross-sectional view of the sound damping device.

The operation of the sound damping device 100 will be described next. FIG. 4 is a cross-sectional view of the sound damping device 100 for explaining the operation of the sound damping device 100.

As shown in FIG. 4, the drum head DH is struck by a beater BT of a foot pedal FP at an impact point P on the striking surface. The sound damper 1 is disposed such that the height at which the through-hole 12 is located and the height of the impact point P are essentially the same.

The drum head DH that has been struck is in contact with the contact surface 11 of the sound damper 1 and suppresses the vibration of the drum head DH and the other members to thereby reduce the sound volume of the bass drum BD (sound damping step).

The struck drum head DH vibrates, causing the air in the vicinity of the drum head DH to vibrate. As shown in FIG. 4, the vibration of the air A is transmitted in the axial direction through the through-hole 12 of the sound damper 1 (first transmission step). The vibration of the air A that has been transmitted in the first transmission step is further transmitted to a front head FH side via the air holes 24 (second transmission step).

As shown in FIG. 4, the vibration of the air A that has been transmitted through the through-hole 12 and the air holes 24 is transmitted to the front head FH and vibrates the front head FH. The vibration of air that is generated by the respective vibrations of the drum head DH and the front head FH resonates as sound, and the sound of the bass drum BD is thereby emitted.

Since the contact surface 11 of the sound damper 1 is supported in contact with the drum head DH, the sound volume of the bass drum BD of the acoustic drum can be suitably reduced. Moreover, it is possible to transmit the vibration of the air A that is generated by the impact via the through-hole 12 and the air holes 24 to the front head FH, and to vibrate the front head FH and the entire bass drum in order to emit sound. With the two effects, the sound volume of the bass drum BD can be appropriately reduced in a well-balanced manner.

It is possible to adjust the amount of the air A that is transmitted to the front head FH in order to adjust the sound volume of the bass drum BD by adjusting the sizes of the through-hole 12 and the air hole 24.

In addition, the sound volume of the bass drum BD can also be adjusted by adjusting the size of the contact surface 11 of the sound damper 1.

Effect of First Embodiment

By means of the sound damping device 100 of the present embodiment, it is possible to appropriately reduce the sound volume of a percussion instrument that emits a high volume of sound, such as the bass drum BD of an acoustic drum.

The first embodiment was described above with reference to the drawings, but the specific configurations are not limited to this embodiment, and this disclosure includes design modifications, etc., that do not depart from the scope of the invention. In addition, the constituent elements shown in the first embodiment above and in the following modified examples can be appropriately combined and configured.

First Modified Example

For example, in the above-described embodiment, the sound damper 1 is formed with an annular shape, but the sound damper is not limited to this shape. The sound damper can have a notched portion, so as to be U-shaped. It is sufficient for the sound damper to have a cavity, such as a through-hole, that can transmit the vibration of the air of the drum head (vibration member) to the air hole of the support member.

Second Modified Example

Figure 5:
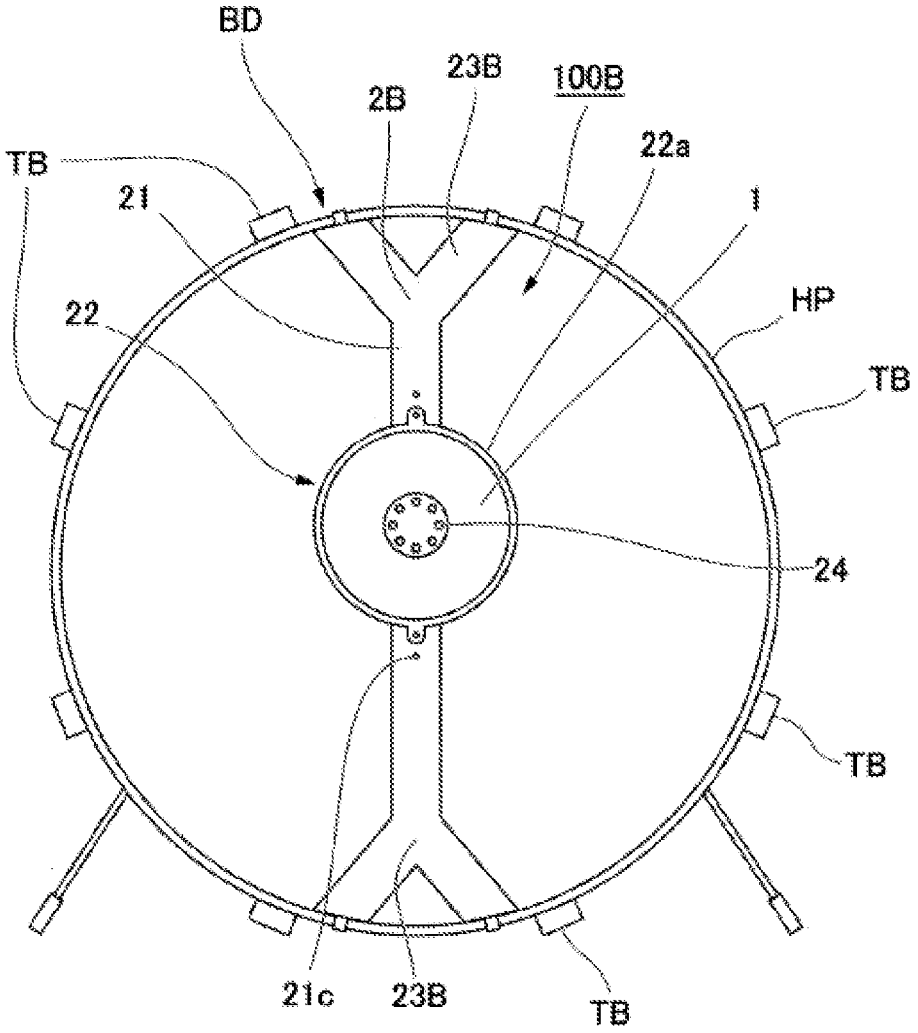
FIG. 5 is a plan view of a modified example of the sound damping device.

For example, in the above-described embodiment, the support member main body 21 of the support member 2 is an extended member, and one mounting part 23 is provided at each end of the support member main body 21, but the form of the support member 2 is not limited in this way. FIG. 5 is a plan view of a support member 2B, which is a modified example of the support member. As shown in FIG. 5, the support member main body 21 can be formed so that at both ends of the support member 2B a Y-shape is formed, and two mounting parts 23B each can be provided thereto. Compared to the support member 2, the support member 2B can more stably support the sound damper 1.

Third Modified Example

For example, in the embodiment described above, the through-hole 12 and the air hole 24 are formed in the axial direction of the bass drum BD, but the through-hole and the air hole is not limited in this way. The through-hole and the air hole can be formed in a direction inclined with respect to the axial direction of the bass drum BD. As long as the through-hole and the air hole can transmit the vibrating air of the drum head (vibration member) to a portion of the bass drum, it is possible to vibrate the entire bass drum in order to emit sound.

Second Embodiment

The second embodiment is described with reference to FIGS. 6 and 7. In the following description, the configurations, etc., that are the same as those already explained have been assigned the same reference numerals and redundant descriptions have been omitted.

Figure 6:
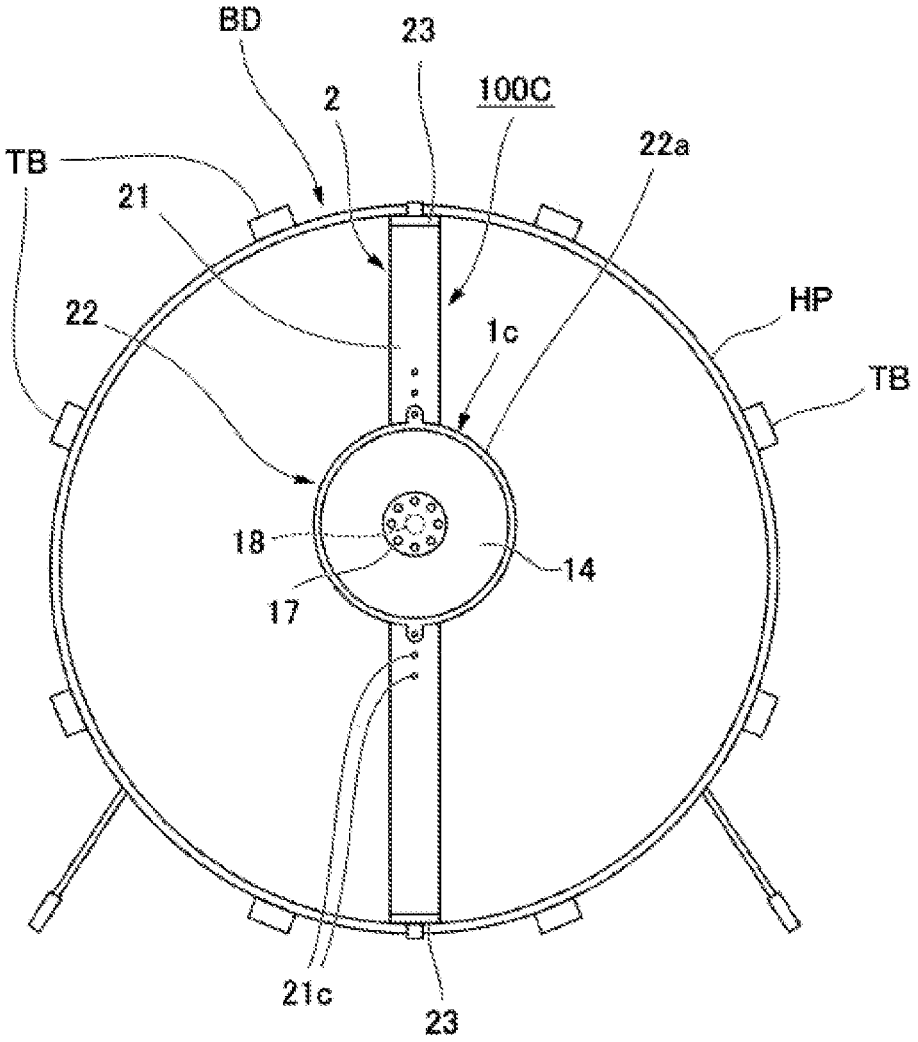
FIG. 6 is a plan view showing an overall configuration of a vibration detection device according to a second embodiment.

FIG. 6 is a plan view of a vibration detection device 100C according to the present embodiment. FIG. 7 is a cross-sectional view of the vibration detection device 100C. The vibration detection device 100C shown in FIGS. 6 and 7 is mounted on the bass drum BD of an acoustic drum.

Figure 7:
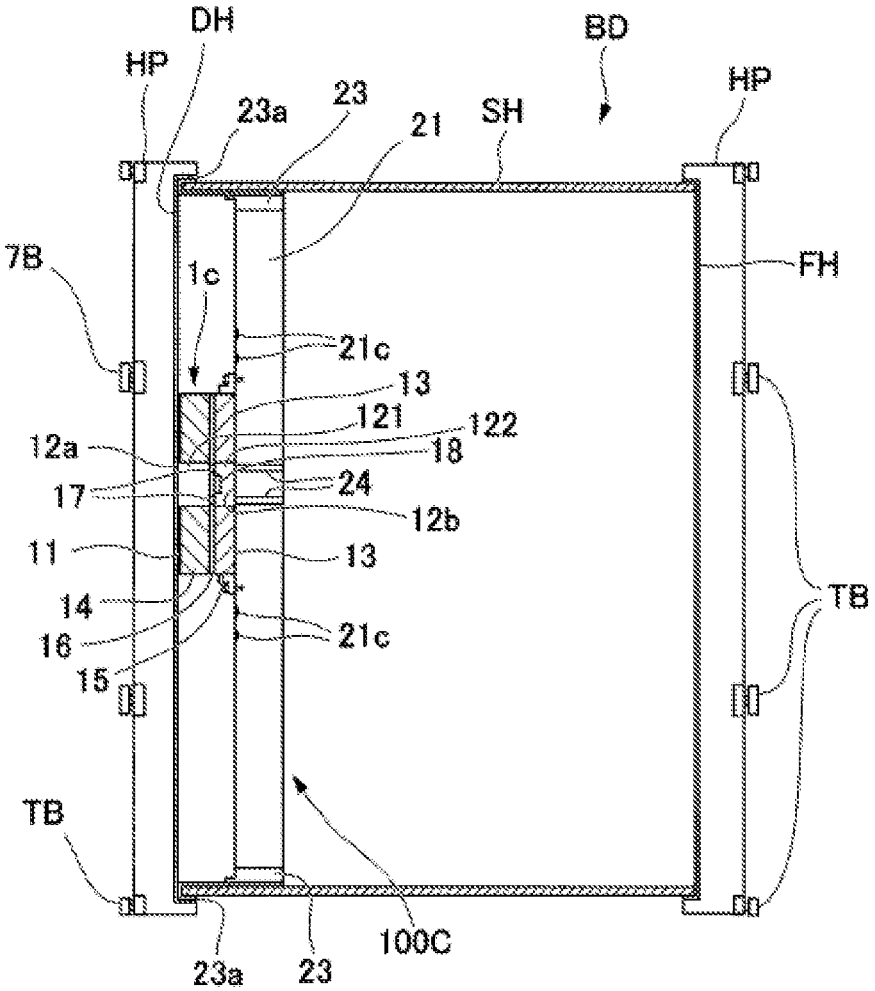
FIG. 7 is a cross-sectional view of the vibration detection device.

As shown in FIGS. 6 and 7, the vibration detection device 100C has a sound damper 1*c* and a support member 2. The vibration detection device 100C is mounted on the bass drum BD of the acoustic drum and is used for damping the bass drum BD while detecting vibration of the bass drum BD.

As shown in FIGS. 6 and 7, the sound damper 1*c* includes a first sound damper 14, a second sound damper 15, and a sensor board 16. As shown in FIG. 7, the sensor board 16 is sandwiched between the first sound damper 14 and the second sound damper 15.

Like the sound damper 1 of the first embodiment, the first sound damper 14 and the second sound damper 15 absorb the vibrations of the drum head (vibration member) DH and suppress the vibrations of the drum head DH, and are formed of a material suitable for buffering vibration, such as urethane foam or cloth. Like the sound damper 1 of the first embodiment, the first sound damper 14 and the second sound damper 15 are annular in form. As shown in FIG. 7, the height of the first sound damper 14 in the axial direction is greater than the height of the second sound damper 15 in the axial direction.

As shown in FIG. 7, the first sound damper 14 has the flat contact surface 11 that comes into contact with the rear surface (opposite side surface of the striking surface) of the drum head DH. The opposite-side surface of the contact surface 11 is attached to the sensor board 16 using an adhesive, or the like.

As shown in FIG. 7, a first through-hole 121 is formed in the first sound damper 14, and the first through-hole 121 has a first opening 12*a* on the contact surface 11. As shown in FIG. 7, the first through-hole 121 is formed at the center of the first sound damper 14, as viewed in the axial direction of the bass drum BD.

One surface of the second sound damper 15 is attached to the sensor board 16 using an adhesive, or the like. As shown in FIG. 7, the supporting surface 13, which is the other surface of the second sound damper 15, is flat and supported by the support member 2.

As shown in FIG. 7, a second through-hole 122 is formed in the second sound damper 15, and the supporting surface 13 has the second opening 12*b*. As shown in FIG. 7, the second through-hole 122 is formed at the center of the second sound damper 15 when viewed in the axial direction of the bass drum BD.

As shown in FIG. 7, the central axes of the first through-hole 121 and the second through-hole 122 coincide as viewed in the axial direction of the bass drum BD, and the diameters thereof are the same.

As shown in FIG. 7, the plurality of air holes 24 of the support member 2 communicate with the second through-hole 122 via the second opening 12*b*.

The sensor board 16 is a disk-shaped substrate having a vibration detector 18. As viewed in the axial direction of the bass drum BD, the outer peripheral shapes of the first sound damper 14, the second sound damper 15, and the sensor board 16 match.

The vibration detector 18 is a device for detecting vibration, and a sensor appropriately selected from known vibration sensors can be used therefor. The vibration detector 18 can detect the magnitude of the vibration that occurs in the sensor board 16. Here, the sensor board 16 can be an electronic board provided with an electronic circuit connected to the vibration detector 18. A cable (not shown) that can transmit the detected vibrations from the vibration detector 18 is connected to the sensor board 16, and the cable is wired to the outside of the bass drum BD. The cable is wired to the outside of the bass drum BD from, for example, a hole formed in the front head FH.

The sensor board 16 has at least one hole 17 that communicates with the first through-hole 121 of the first sound damper 14 and the second through-hole 122 of the second sound damper 15, and that penetrates the sensor board 16 in the axial direction. In the present embodiment, the sensor board 16 has a plurality of holes 17. As shown in FIG. 6, the plurality of the holes 17 are arranged on the same circumference as viewed from the axial direction.

The first through-hole 121, the second through-hole 122, and the plurality of holes 17 form the "through-holes of the sound damper 1*c*" which penetrate from the first opening 12*a* to the second opening 12*b* of the sound damper 1*c*.

As shown in FIG. 6, the vibration detector 18 is arranged at the center of the sensor board 16, as viewed in the axial direction of the bass drum BD. As shown in FIG. 6, the plurality of holes 17 are formed in the periphery of the vibration detector 18.

The operation of the vibration detection device 100C will be described next.

The drum head DH is struck by the beater BT of the foot pedal FP at the impact point P on the striking surface. The first sound damper 14 is disposed such that the height at which the first through-hole 121 is located and the height of the impact point P are essentially the same.

The drum head DH that has been struck is in contact with the contact surface 11 of the first sound damper 14 and suppresses the vibrations of the drum head DH and the other members to thereby reduce the sound volume of the bass drum BD (sound damping step). The second sound damper 15 assists in the suppression of the vibrations of the drum head DH, and the like.

The drum head DH that has been struck vibrates and the air in the vicinity of the drum head DH vibrates. The vibrating air A is transmitted in the axial direction via the first through-hole 121 of the first sound damper 14. The vibrating air A that is transmitted via the first through-hole 121 is transmitted to the second through-hole 122 of the second sound damper 15 via the plurality of holes 17 formed in the sensor board 16. Moreover, the vibrating air A is transmitted in the axial direction through the second through-hole 122 of the second sound damper 15 (first transmission step). The vibrating air A that has been transmitted in the first transmission step is further transmitted to the front head FH side via the air hole 24 (second transmission step).

The vibrating air A that has been transmitted through the first through-hole 121, the second through-hole 122, and the air hole 24 is transmitted to the front head FH and vibrates the front head FH. The vibrating air that is generated by the respective vibrations of the drum head DH and the front head FH resonates as sound, and the sound of the bass drum BD is thereby emitted.

Since the contact surface 11 of the first sound damper 14 is supported in contact with the drum head DH, the sound volume of the bass drum BD of the acoustic drum can be suitably reduced. Moreover, it is possible to transmit the vibrating air A that is generated by the impact via the first through-hole 121, the second through-hole 122, and the air hole 24 to the front head FH, and to vibrate the entire bass drum in order to emit sound. With the two effects, the sound volume of the bass drum BD can be appropriately reduced.

The vibration detector 18 of the sensor board 16 detects the vibration of the drum head DH that is transmitted via the first sound damper 14 and outputs the detected result to the cable. For example, a performer can convert the detected vibrations into electronic sounds and superimpose the electronic sounds on the sounds from the bass drum BD, or emit sounds from a sound source that were prerecorded using the detected vibrations as a trigger, and superimpose the sounds on the sounds from the bass drum BD.

Effect of Second Embodiment

By means of the vibration detection device 100C of the present embodiment, it is possible to provide a device that can appropriately reduce the sound volume of the percussion instrument that emits a high volume of sound, such as the bass drum BD of the acoustic drum, while detecting vibrations. The detected vibrations can be used for various purposes.

The second embodiment was described above with reference to the drawings, but the specific configurations are not limited to this embodiment, and this disclosure includes design modifications, etc., that do not depart from the scope of the invention. In addition, the compositional elements shown in the second embodiment above and the modified example shown below can be appropriately combined and configured.

Fourth Modified Example

For example, in the above-described embodiment, the vibration detector 18 is arranged at the center of the sensor board 16, as viewed in the axial direction of the bass drum BD, but the form of the vibration detector is not limited thereto. The vibration detector can detect the vibrations of the sensor board as long as it is attached to anywhere on the sensor board.

This disclosure can be applied to a percussion instrument that emits a high volume of sound, such as a bass drum of an acoustic drum.

What is claimed is:

1. A sound damping device configured to be mounted on a percussion instrument that includes a cylindrical drum shell which has one open end and an other open end opposite to the one open end, a drum head that is mounted on the one open end of the cylindrical drum shell and vibrates by being struck, and a front head that is mounted on the other open end of the cylindrical drum shell, the sound damping device comprising:

a sound damper that includes a contact surface configured to contact with a rear surface of the drum head, and that includes a through-hole having a first opening formed on the contact surface, the rear surface of the drum head facing toward the front head; and a support member configured to be attached to the cylindrical drum shell, and coupled to the sound damper to support the sound damper and cause the rear surface of the drum head and the contact surface to come into contact with each other, the support member including an air hole that is connected to the through-hole of the sound damper and that penetrates through the support member, the first opening of the through-hole overlapping an impact point at which the drum head is struck.

2. The sound damping device according to claim 1, wherein the sound damper further includes a supporting surface on an opposite side of the contact surface, and the through-hole further has a second opening formed on the supporting surface, and the air hole communicates with the through-hole via the second opening.

3. The sound damping device according to claim 1, wherein the sound damper has an annular shape.

4. The sound damping device according to claim 1, wherein the support member supports the sound damper such that a position of the sound damper is adjustable along the contact surface.

5. A vibration detection device configured to be mounted on a percussion instrument that includes a cylindrical drum shell which has one open end and an other open end opposite to the one open end, a drum head that is mounted on the one open end of the cylindrical drum shell and vibrates by being struck, and a front head that is mounted on the other open end of the cylindrical drum shell, the vibration detection device comprising:

a sound damper that includes a contact surface configured to contact with a rear surface of the drum head, and that includes a through-hole having a first opening formed on the contact surface, the rear surface of the drum head facing toward the front head; and a support member configured to be attached to the cylindrical drum shell, and coupled to the sound damper to support the sound damper and cause the rear surface of the drum head and the contact surface to come into contact with each other, the support member including an air hole that is connected to the through-hole of the sound damper and that penetrates through the support member, the sound damper further including a vibration detector configured to detect vibration, the first opening of the through-hole having overlapping an impact point at which the drum head is struck.

6. The vibration detection device according to claim 5, wherein the sound damper further includes a supporting surface on an opposite side of the contact surface, and the through-hole further has a second opening formed on the supporting surface, and the air hole communicates with the through-hole via the second opening.

7. A vibration detection device comprising:

a sound damper that includes a contact surface configured to contact with a vibration member and that includes a through-hole having a first opening formed on the contact surface; and a support member coupled to the sound damper to support the sound damper and cause the vibration member and the contact surface to come into contact with each other, the sound damper further including a vibration detector configured to detect vibration, the sound damper including a first sound damper, a second sound damper, and a sensor board to which the vibration detector is coupled, the first sound damper having a first through-hole, the second sound damper having a second through-hole, and the sensor board being sandwiched between the first sound damper and the second sound damper and having a hole that communicates with the first through-hole and the second through-hole.

8. The sound damping device according to claim 2, wherein the sound damper has an annular shape.

9. The sound damping device according to claim 2, wherein the support member supports the sound damper such that a position of the sound damper is adjustable along the contact surface.

10. The sound damping device according to claim 3, wherein the support member supports the sound damper such that a position of the sound damper is adjustable along the contact surface.

11. The vibration detection device according to claim 7, wherein the sound damper further includes a supporting surface on an opposite side of the contact surface, and the through-hole further has a second opening formed on the supporting surface, and the air hole communicates with the through-hole via the second opening.

* * * * *